United States Patent [19]

Mauch

[11] Patent Number: 4,744,288

[45] Date of Patent: May 17, 1988

[54] AXIAL PISTON PUMPS AND MOTORS

[75] Inventor: David L. Mauch, Westerville, Ohio

[73] Assignee: Commercial Shearing, Inc., Youngstown, Ohio

[21] Appl. No.: 901,288

[22] Filed: Aug. 28, 1986

[51] Int. Cl.[4] ..... F01B 13/04

[52] U.S. Cl. ..... 92/57; 92/71; 91/488

[58] Field of Search ..... 92/57, 71; 91/488

[56] References Cited

U.S. PATENT DOCUMENTS

| | | | |
|---|---|---|---|
| Re. 24,048 | 8/1955 | Wright | 92/57 |
| 3,256,782 | 6/1966 | Ebert | 92/57 |
| 4,516,475 | 5/1985 | Fricke | 92/57 |

*Primary Examiner*—A. Michael Chambers

*Attorney, Agent, or Firm*—Buell, Ziesenheim, Beck & Alstadt

[57] ABSTRACT

An axial piston pump is disclosed which includes a housing, a cylindrical bore in the housing, a piston barrel rotatable in the bore and spaced from the bore walls and an antifriction bearing structure surrounding the barrel between the barrel and the bore. A plurality of axial piston are provided in the barrel which are open at one end and have fluid passages through the barrel at the other end. A piston is provided in each such piston bore which extends out of the open end. A spring is provided between each piston and the other end of the piston bore. A fixed ramp swash plate is provided in the housing bore beneath the extending pistons and an antifriction thrust bearing is provided between the swash plate and pistons. An axial drive shaft is provided on the barrel which extends through an antifriction bearing in an opening in the housing opposite the bore for drivingly engaging on external drive structure. Additionally, a removable port cap is provided on the housing over the bore which has inlet and outlet ports communicating with fluid passages in the barrel.

9 Claims, 2 Drawing Sheets

AXIAL PISTON PUMPS AND MOTORS

This invention relates to axial piston pumps and motors and particularly to small multi-piston pumps of the swash plate type for pumping substantial quantities of fluids of relatively low lubrication at elevated pressures.

Axial piston pumps and motors of the swash plate type are well known in the hydraulic field and are used as the primary source of fluid pressure for many hydraulically operated devices such as high lifts, back hoes, excavators, graders and various other construction and industrial equipment. In general, such pumps and motors are large, heavily built devices operating in hydraulic fluid of reasonably good lubricity.

There are instances where axial piston pumps of miniature size would be desirable for pumping fluids of various types and lubricities as in control circuits, braking circuits and the like where fluids such as silicon oils or the like may be used. Attempts simply to scale down the large axial piston pumps for such purposes have generally failed for a variety of reasons. One important reason for the failure is, as might be expected, lack of adequate lubrication. Another is the difficulty of miniaturizing the many parts of conventional axial piston pumps, such as slippers, slipper guides and the like, while maintaining strength, ease of assembly and economy of repair and maintenance.

I have developed a small multi-piston axial piston pump which solves these problems and which can be used for pumping fluids of low lubricity such as silicon oils at high pressure and high speeds I have also discovered, surprisingly, that all steel construction allows close clearances between parts to minimize leakage of very thin fluids, such as currently used brake fluids, while allowing operation over a wide temperature range without seizure. The pump of this invention is not a scaled down version of existing axial piston pumps but is a whole new concept in such pumps.

I provide an axial piston pump of the swash plate type comprising a housing, a cylindrical bore in said housing, a piston barrel rotatable in said bore and spaced from the bore walls, antifriction bearing means surrounding said barrel, between said barrel and bore, a plurality of axial piston bores in said barrel spaced around the barrel axis and open at one end and having fluid passages through the barrel at the other end, a piston in each such piston bore extending out of said open end, spring means on each piston and said other end of the piston bore urging the pistons out of the bore, a fixed ramp swash plate in the housing bore beneath said extending pistons, antifriction thrust bearing means between said swash plate and pistons, an axial drive shaft on the barrel extending through and supported in an antifriction bearing in an opening in the housing opposite the bore for drivingly engaging an external drive means and removable port cap means on said housing over said bore having inlet and outlet ports communicating with the fluid passages in the barrel. Preferably the antifriction bearing means between the barrel and bore is a needle roller bearing. The antifriction thrust bearing means between the swash plate and pistons is preferably a needle roller bearing between two washers. The antifriction bearing surrounding and supporting the drive shaft is preferably a ball bearing. The port cap means is preferably attached to the housing by displaced bolts and sealed thereto by means of an O-ring.

In the foregoing general description of this invention I have set out certain objects, purposes and advantages of this invention. Other objects, purposes and advantages of the invention will be apparent from a consideration of the following description and the accompanying drawings in which FIG. 1 is a side elevation view, partly in section of an axial piston pump according to this invention;

Figure 1:
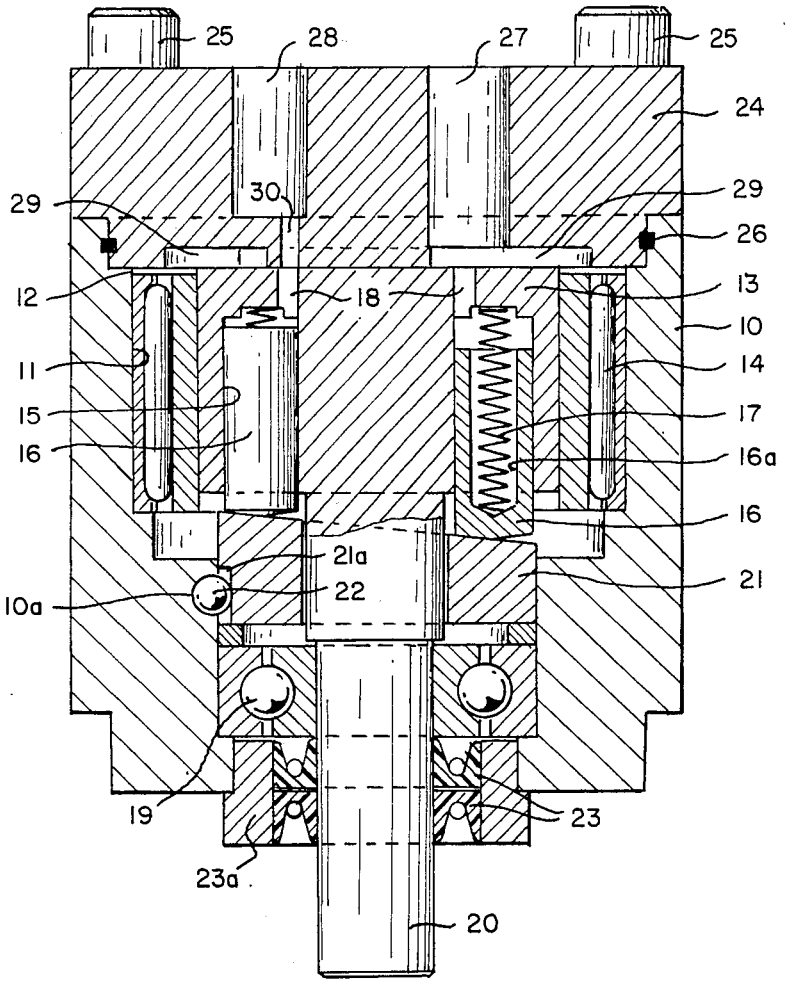
Figure 5:
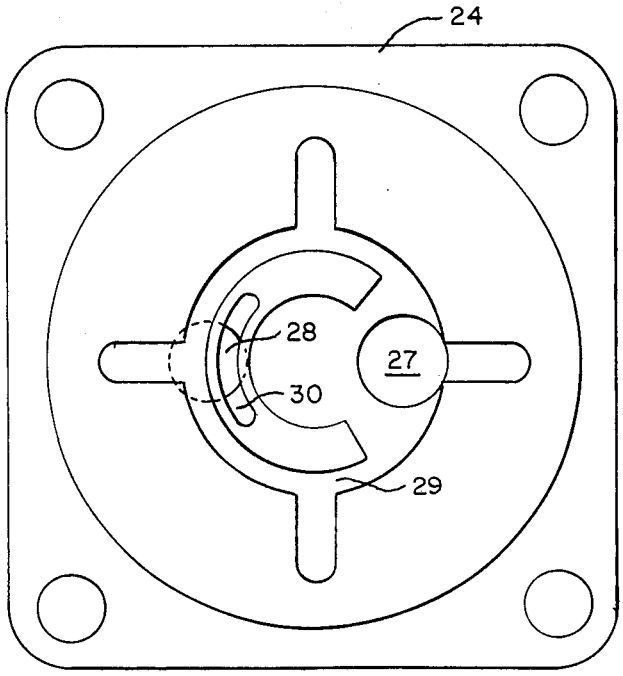
FIG. 5 is a bottom plan view of the port cap of the pump of FIG. 1.
Figure 2:
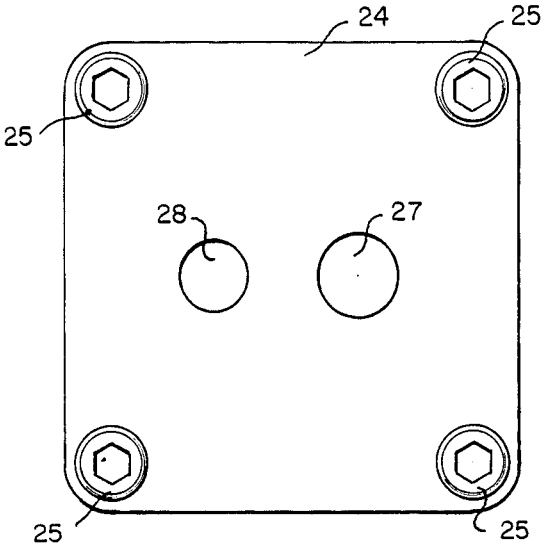
FIG. 2 is a top plan view of the pump of FIG. 1.
Figure 3:
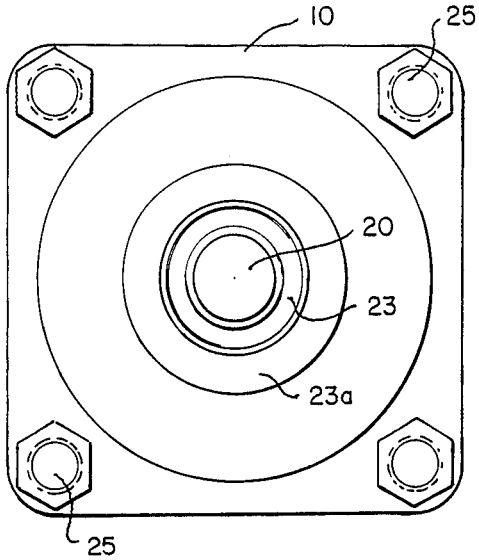
FIG. 3 is a bottom plan view of the pump of FIG. 1.
Figure 4:
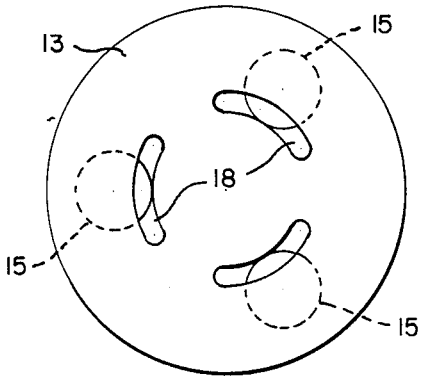
FIG. 4 is a top plan view of the pump barrel of the pump of FIG. 1.

Referring to the drawings I have illustrated a pump housing 10 of generally square cross-section having a central cylindrical bore 11 therein open at one end 12 to receive a piston barrel 13 journalled in needle roller bearing 14 between the barrel 13 and bore 11. The barrel 11 is provided with three piston bores 15 axially thereof, open at one end to receive pistons 16, each having a central bore **16*a* carrying a spring 17 which bears against the top of piston bore 15 to urge the piston out of the bore. Each piston bore 15 has a passage 18 extending through the top of the barrel 13. The bore 11 is stepped down in the diameter intermediate the thickness of housing 10 to carry out friction bearing 19 surrounding and supporting drive shaft 20 on barrel 13. Drive shaft 20 extends out of housing 10 and is adapted to be driven by a power source such as an electric motor Surrounding drive shaft 20 between bearing 19 and barrel 13 is a fixed ramp swash plate 21 which is held against rotation by a ball 22 in groove 21*a* of the ramp and recess 10*a* of the housing. The contacting surfaces of the ramp 21 and end of piston 16 are preferably Melonized to provide an antifriction bearing surface. Chevron seals 23 are held in place around the drive shaft 20 by compression ring 24 to seal the bearing from the exterior of housing 10**.

A port cap 24 covers the open end of bore 11 and is held in place by cap screws 25. An O-ring 26 between port cap 24 and housing 10 acts to seal the end cap to the housing to retain fluid in the housing even at elevated pressures. The port cap 24 is provided with an inlet port 27 and an outlet port 28. The inlet port 27 communicates with inlet slot 29 on the underside of the port cap. The outlet port 28 communicates with outlet slot on the underside of the port cap. As the barrel 13 rotates the pistons 16 reciprocate in piston bores 15. Their timing in rotation on ramp 21 is such that they are in communication with the inlet slot 29 when they are maximum removed from the piston bores so that as piston bores 15 fill with fluid on rotation they move out of contact with the inlet slot and into communication with the outlet slot at which time they discharge fluid to outlet port 28. The antifriction bearing 14 between the barrel 13 and housing 10 eliminates any problem of frictional heating and galling between those relatively rotating parts. Similarly the antifriction Melonized surface between swash plate ramp and piston ends eliminates frictional heating, wear and galling of the parts. As a result the pump of this invention can run at high pressures for extended periods without overheating or galling.

Figure 6:
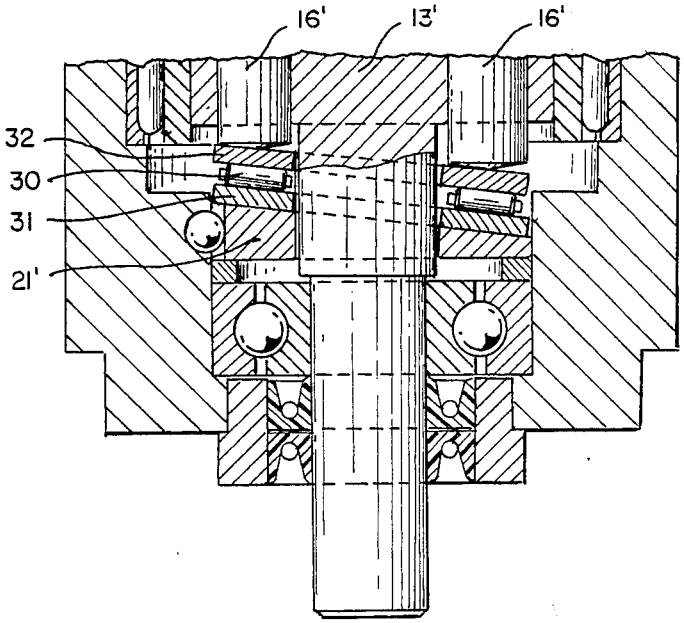
FIG. 6 is a fragmentary section of a second embodiment of pump structure of this invention using a thrust bearing and washers.

In FIG. 6 I have illustrated another form of antifriction thrust bearing arrangement between the swash plate ramp 21' and piston ends 16'. In this embodiment a needle roller thrust bearing 30 between washers 31 and 32 is substituted for the Melonized antifriction surface on one or both of the ramp 21 and pistons 16 of FIG. 1. The balance of the structure is the same.

In the foregoing specification I have set out certain preferred practices and embodiments of this invention, however, it will be understood that this invention may be otherwise practiced within the scope of the following claims.

I claim:

1. An axial piston pump comprising a housing, a cylindrical bore in said housing, a piston barrel rotatable in said bore and spaced from the bore walls, antifriction bearing means surrounding said barrel between said barrel and bore, a plurality of axial piston bores in said barrel open at one end and having fluid passages through the barrel at the other end, a piston in each such piston bore extending out of said open end, spring means between each piston and said other end of the piston bore, a fixed ramp swash plate in the housing bore beneath said extending pistons, antifriction thrust bearing means between the swash plate and pistons, an axial drive shaft on the barrel extending through an antifriction bearing in an opening in the housing opposite the bore for drivingly engaging an external drive means and removable port cap means on said housing over said bore having inlet and outlet ports communicating with the fluid passages in the barrel.

2. An axial piston pump as claimed in claim 1 wherein the antifriction bearing means between the barrel and housing bore is a needle roller bearing.

3. An axial piston pump as claimed in claim 1 or 2 wherein the antifriction bearing means between the swash plate ramp and piston ends is a pair of washers separated by a needle roller thrust bearing.

4. An axial piston pump as claimed in claim 1 or 2 wherein the antifriction bearing means between the swash plate ramp and piston ends is a Melonized surface on at least one of the swash plate ramp and piston ends in contact with each other.

5. An axial piston pump as claimed in claim 1 or 2 wherein the antifriction bearing means surrounding and supporting the drive shaft is a ball bearing.

6. An axial piston pump as claimed in claim 3 wherein the antifriction bearing means surrounding and supporting the drive shaft is a ball bearing.

7. An axial piston pump as claimed in claim 4 wherein the antifriction bearing means surrounding and supporting the drive shaft is a ball bearing.

8. An axial piston pump as claimed in claim 1 or 2 wherein said pump is constructed entirely of steel.

9. An axial piston pump as claimed in claim 3 wherein said pump is constructed entirely of steel.

* * * * *

UNITED STATES PATENT AND TRADEMARK OFFICE

CERTIFICATE OF CORRECTION

PATENT NO. : 4,744,288

DATED : May 17, 1988

INVENTOR(S) : DAVID L. MAUCH

It is certified that error appears in the above-identified patent and that said Letters Patent is hereby corrected as shown below:

Column 2, line 34, after "motor" insert --.--.

Column 2, line 52, after "slot" insert --30--.

Signed and Sealed this

Fifteenth Day of November, 1988

*Attest:*

DONALD J. QUIGG

*Attesting Officer*

*Commissioner of Patents and Trademarks*